US010933337B2

(12) United States Patent
Kiani

(10) Patent No.: US 10,933,337 B2
(45) Date of Patent: Mar. 2, 2021

(54) AMUSEMENT RIDE WITH CONTROLLABLE AND RACER MOTORCYCLE TO SIMULATE MOTORCYCLE RIDING

(71) Applicant: Ali Kiani, Coquitlam (CA)

(72) Inventor: Ali Kiani, Coquitlam (CA)

(73) Assignee: Ali Kiani

( * ) Notice: Subject to any disclaimer, the term of this patent is extended or adjusted under 35 U.S.C. 154(b) by 0 days.

(21) Appl. No.: 16/961,742

(22) PCT Filed: Jan. 16, 2019

(86) PCT No.: PCT/CA2019/050057
§ 371 (c)(1),
(2) Date: Jul. 13, 2020

(87) PCT Pub. No.: WO2019/140520
PCT Pub. Date: Jul. 25, 2019

(65) Prior Publication Data

US 2020/0376396 A1 Dec. 3, 2020

(30) Foreign Application Priority Data

Jan. 17, 2018 (CA) ..... CA 2992182

(51) Int. Cl.
*A63G 25/00* (2006.01)
*A63G 7/00* (2006.01)

(52) U.S. Cl.
CPC ..... *A63G 25/00* (2013.01); *A63G 7/00* (2013.01)

(58) Field of Classification Search
CPC ..... A63G 25/00; A63G 31/02; A63G 7/00; B60L 9/00; B61B 13/00
See application file for complete search history.

(56) References Cited

U.S. PATENT DOCUMENTS

| | | | | |
|---|---|---|---|---|
| 5,595,121 | A * | 1/1997 | Elliott | B61B 13/00 104/53 |
| 5,791,254 | A * | 8/1998 | Mares | A63G 7/00 104/53 |
| 5,979,333 | A * | 11/1999 | Houben | A63G 21/22 104/63 |
| 6,158,354 | A * | 12/2000 | Eiraku | A63G 7/00 104/53 |
| 6,405,655 | B1 * | 6/2002 | Clerx | A63G 7/00 104/63 |
| 6,513,441 | B1 * | 2/2003 | Clerx | A63G 7/00 104/53 |
| 7,204,559 | B2 * | 4/2007 | Berra | B60R 21/02 297/466 |
| 8,132,513 | B2 * | 3/2012 | Crawford | A63G 7/00 104/53 |
| 10,525,361 | B2 * | 1/2020 | Cummins | A63G 21/04 |
| 10,683,019 | B2 * | 6/2020 | Laffin | A63G 21/04 |
| 10,766,502 | B2 * | 9/2020 | Roodenburg | A63G 7/00 |
| 2005/0288111 | A1 * | 12/2005 | Cowan | A63G 19/20 472/96 |
| 2007/0199474 | A1 * | 8/2007 | Zamperla | A63G 21/20 104/53 |
| 2009/0031913 | A1 * | 2/2009 | Heaslip | A63G 25/00 104/63 |

* cited by examiner

*Primary Examiner* — Jason C Smith

(57) ABSTRACT

An amusement ride with controllable, and a racer motorcycle enabling at least one rider accelerating of the racer motorcycle and changing a position and an orientation of said at least one rider in relation to a vertical line during a riding.

18 Claims, 9 Drawing Sheets

AMUSEMENT RIDE WITH CONTROLLABLE AND RACER MOTORCYCLE TO SIMULATE MOTORCYCLE RIDING

FIELD OF THE INVENTION

The invention relates to the field of amusement rides. More particularly, the invention to be used to simulate a motorcycle riding wherein enables at least one rider to control a speed along a route and changing an orientation in relation to a vertical line during a riding

BACKGROUND

Roller coasters have long been some of the well liked riders in amusement parks. Rider load and unload at a platform, typically at the low elevation. At the beginning of each ride cycle, a roller coaster vehicle is locked to be safe to upload riders. Vehicle is then released to gain kinetic energy from potential energy, if it is at the highest point of the track, or from electrical motor installed on the vehicle or track. The roller coaster track typically includes various loops, turns, inversions and other configuration intended to thrill the rider. A number of amusement rides have been devised in which riders can apparently race each other in a simulated dragster format.

Traditional roller coasters travel along rail tracks and provide their riders with stationary seat which fix the motion of the riders to the direction of the travel of vehicle.

The overall effect attained by traditional roller coasters is to statically couple riders to the vehicle and therefore sense essentially the same motions in forces experienced by the vehicles in which they ride. This problem is experienced by most amusement rides, which due to static nature of the ride provides the same ride sensation and experience every time it is ridden.

Nowadays amusement rides have evolved from simple equipment to advanced and technically sophisticated equipment with special mechanisms and various movements. Thanks to virtual reality and by using new technology, new designs and software, riders experience more joy and excitement of amusement rides.

DESCRIPTION

Described amusement ride simulating a motorcycle riding wherein enables at least one rider to control a speed along a route and changing an orientation in relation to a vertical line during a riding

SUMMARY OF THE INVENTION

Therefore, the object of the present invention is to provide an amusement ride simulating a motorcycle riding wherein enables at least one rider to control a speed along a route and changing an orientation and a position in relation to a vertical line during a riding, comprising:

a track including at least one supporting column, at least one set of running rails having an embark point, and a drive blade fixed at a middle of said at least one set of running rails and extended longitudinally through said at least one set of running rails; said at least one supporting column having a bottom section and a top section, said bottom section of said at least one supporting column adapted to be mounted on a ground, and said top section of said supporting column connected to said at least one set of running rails to support said amusement ride;

at least one vehicle arranged to carry said at least one rider along said at least one set of running rails, said at least one vehicle mounted and guided on said at least one set of running rails, said at least one vehicle comprises a main body;

at least one link-slide mechanism mounted on said main body of said at least one vehicle, said at least one link-slide mechanism comprises a moving body, said moving body having a rear section operatively associated with the main body such that said rear section of the moving body moves backward/forward, and having a front section operatively associated with the main body such that said front section of the moving body tilts up and down; a seat mounted on a top section of the moving body for sitting said at least one rider;

at least one drive means mounted between the main body and said at least one link-slide mechanism generating required power to move said at least one link mechanism and enabling said at least one rider tilting the moving body up and down and changing a position and an orientation of said at least one rider in relation to a vertical line during a riding;

at least one launch system accelerating or providing initial motion to said at least one vehicle; and, at least one set bar mounted between said at least one set of running rails and said at least one vehicle; said at least one set bar transferring electrical power to said at least one vehicle.

at least one propulsion drive means generating required power changing a speed of said at least one vehicle along said at least one set of running rails, said at least one propulsion drive means mounted to said bottom section of the main body and engaging said drive blade;

at least one motorcycle rotary hand grip enabling said at least one rider rotating said at least one motorcycle rotary hand grip for activating said at least one drive means and changing the orientation and the position in relation to the vertical line; said at least one motorcycle rotary hand grip enabling said at least one rider activating said at least one propulsion drive means and accelerating said at least one vehicle along said at least one set of running rails;

at least one vehicle park mechanism installed on a ground to maintain said at least one vehicle at a park position while said at least one vehicle is loaded; The at least one vehicle moves along said at least one set of running rails which is configured with one or more of groups consisting of turns, loop, and inversion;

The at least one vehicle further comprises at least two sets of bogies mounting and guiding the main body on said at least one set of running rails;

The at least one vehicle further comprises a shock absorbing means damping a kinetic energy of the moving body when the moving body is tilted down and reaches to the shock absorbing means;

The shock absorbing means includes at least one shock absorber mounted to the main body, the shock absorber engaging the moving body when the moving body is tilted fully down;

The moving body further comprises a seat for sitting said at least one rider, the seat mounted on a top section of the moving body, at least one restraint to maintain said at least one rider safely, said at least one restraint mounted to said rear section of the moving body, two footrests laterally installed at said bottom section of the moving body, said two footrests maintaining the rider's feet, a speaker playing engine sound, two handlebars mounted to said front section of the moving body, and said at least one motorcycle rotary hand grip installed on each one of said two handlebars;

said at least one link-slide mechanism further comprises at least one slide means mounted on the main body and pivotally connected to the rear section of the moving body such that the rear section of the moving body sliding forward/backward longitudinally on the main body;

The slide means comprises at least one rail fixed longitudinally at on the main body, and at least one slider, said at least one slider having a top section, and a bottom section, said top section of said at least one slider is pivotally connected to said rear section of the moving body, and said bottom section of said at least one slider slidably connected to said at least one rail;

The at least one motorcycle rotary hand grip comprises an encoder measuring a rotation angle of said at least one motorcycle rotary hand grip, a spring returning said at least one motorcycle rotary hand grip to a start point wherein said at least one rider releases said at least one motorcycle rotary hand grip;

Said at least one motorcycle rotary hand grip enabling said at least one rider to activate said at least one drive means and said at least one propulsion drive means by rotating said at least one motorcycle rotary hand grip;

The at least one drive means comprises at least one motor gearbox mounted on the main body;

The at least one motorcycle rotary hand grip is sending a signal to said at least one drive means for activating said at least one motor gearbox, said at least one motor gearbox rotates said at least one crank arm for tilting up/down the moving body while the moving body travels forward/backward;

The propulsion drive means further comprises at least one set of motor gearbox and roller mounted to said bottom section of the main body and adapted to engage an outer surface of said drive blade;

The at least one motorcycle rotary hand grip sending a signal to said at least one propulsion drive means for activating said at least one set of motor gearbox and roller, said at least one set of motor gearbox and roller is accelerating said at least one vehicle along said at least one set of running rails.

The propulsion drive means further comprises a freewheel clutch disengaging said at least one propulsion drive means while said at least one launch system accelerating said at least one vehicle.

Furthermore, said at least one link-slide mechanism mounted on said main body of said at least one vehicle can be configured as at least one link-slide mechanism so that said at least one link-slide mechanism comprises a moving body, said moving body having a rear section pivotally connected to the main body, and having a front section operatively associated with the main body such that said front section of the moving body tilts up and down; a seat mounted on a top section of the moving body for sitting said at least one rider; at least one linear actuator mounted between the main body and said at least one link-slide mechanism generating required power to move link-slide mechanism and enabling said at least one rider tilting the moving body up and down and changing an orientation of said at least rider in relation to the vertical line during a riding;

BRIEF DESCRIPTION OF DRAWINGS

Other features and advantages of described invention will become apparent in the following detailed description of preferred embodiments with reference to the appended drawings, of which.

DETAILED DESCRIPTION OF EMBODIMENT

The description which follows and the embodiments described therein are provided by way of illustration of an example of particular embodiment of principles of present invention. This example is provided for the purposes of explanation and not limitation of those principles and of the invention.

Figure 1A:
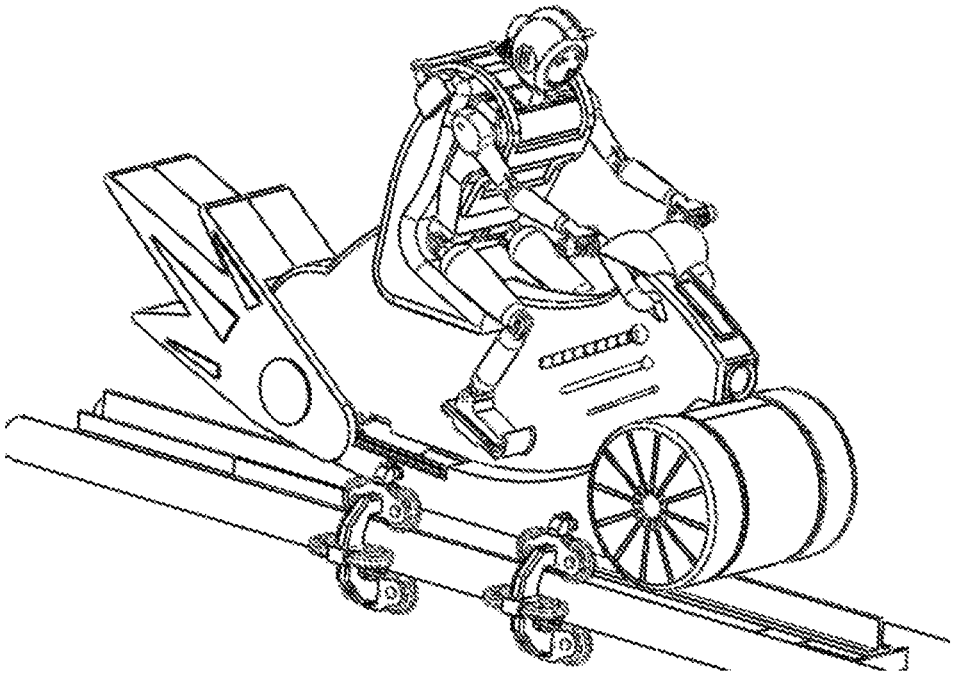
FIG. 1A is a perspective view of described amusement ride, and shows the ride wherein the drive means is not activated.
Figure 1B:
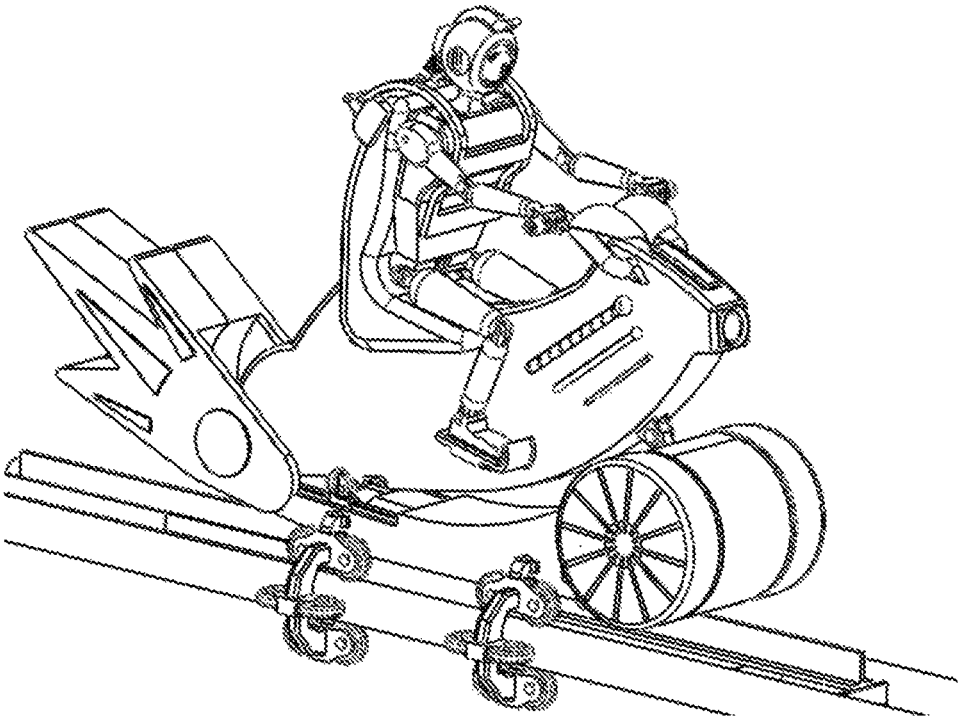
FIG. 1B is a perspective view of described amusement ride, and shows the ride wherein the drive means is activated.
Figure 2A:
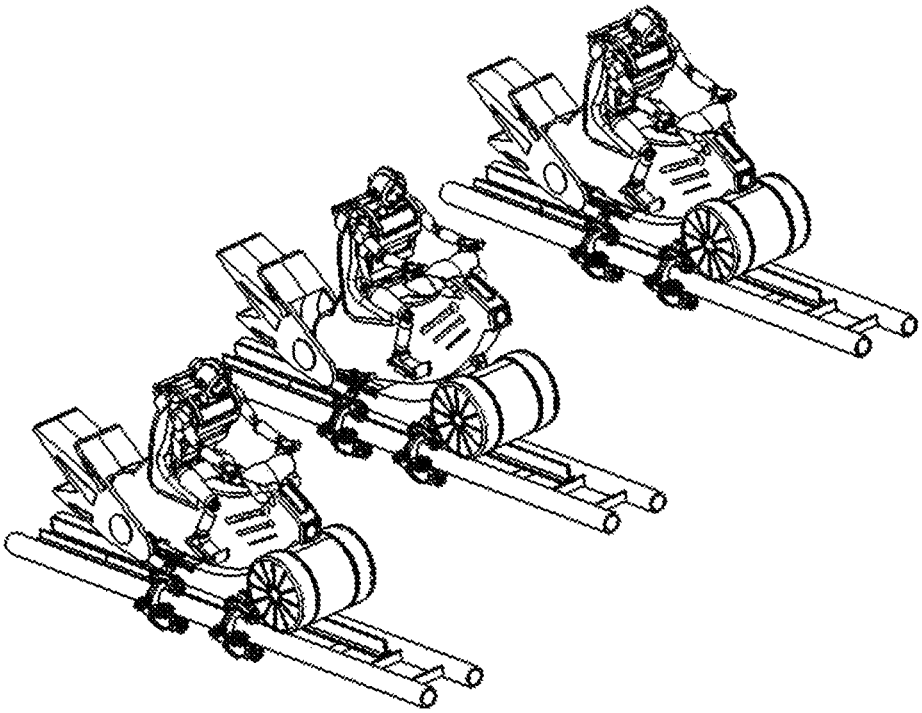
FIG. 2A is a perspective view of described amusement ride showing three racing vehicle.
Figure 2B:
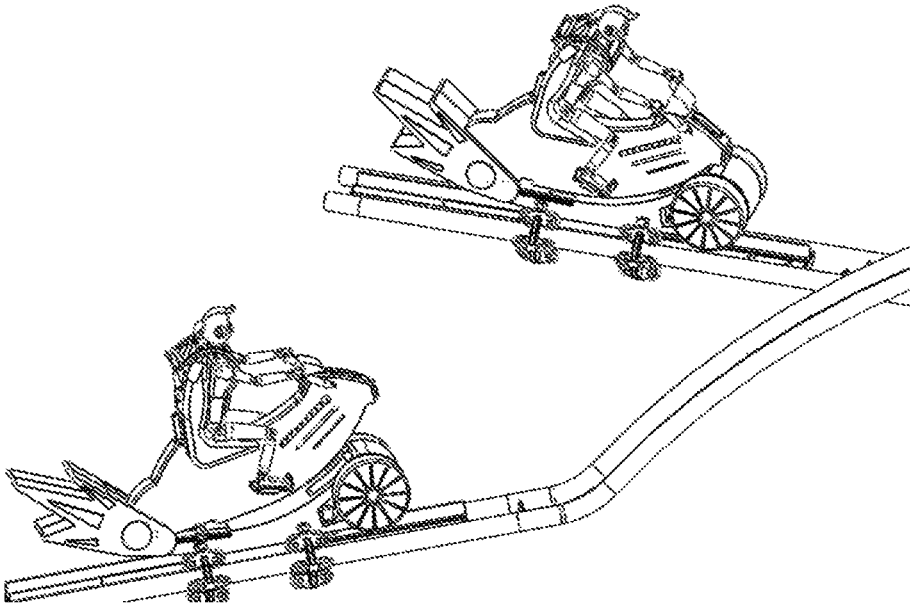
FIG. 2B is a perspective view of described amusement ride showing two racing vehicle.
Figure 3A:
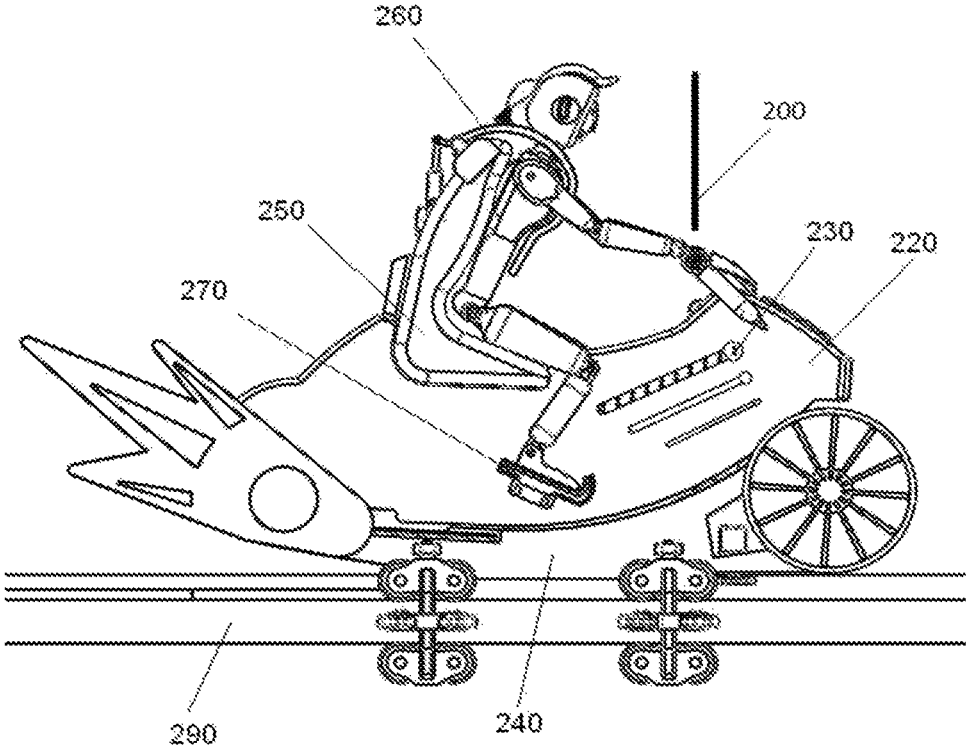
FIG. 3A is a side view of described amusement ride, and shows a vertical line wherein the drive means is not activated.
Figure 3B:
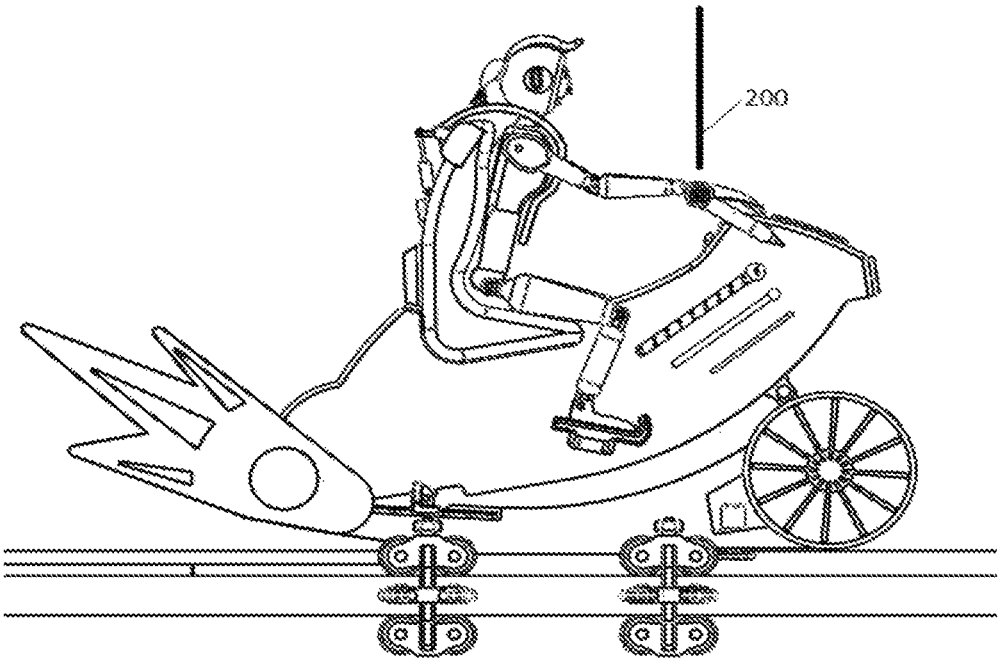
FIG. 3B is a side view of described amusement ride, and shows a vertical line wherein the drive means is activated.
Figure 4A:
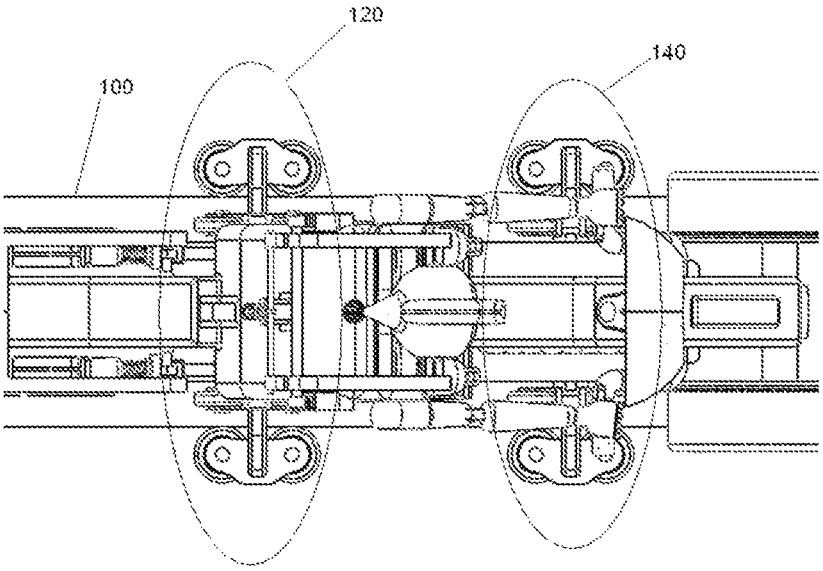
FIG. 4A is a top view of described amusement ride, and shows two set of bogies at a rear end and a front end of the vehicle.
Figure 4B:
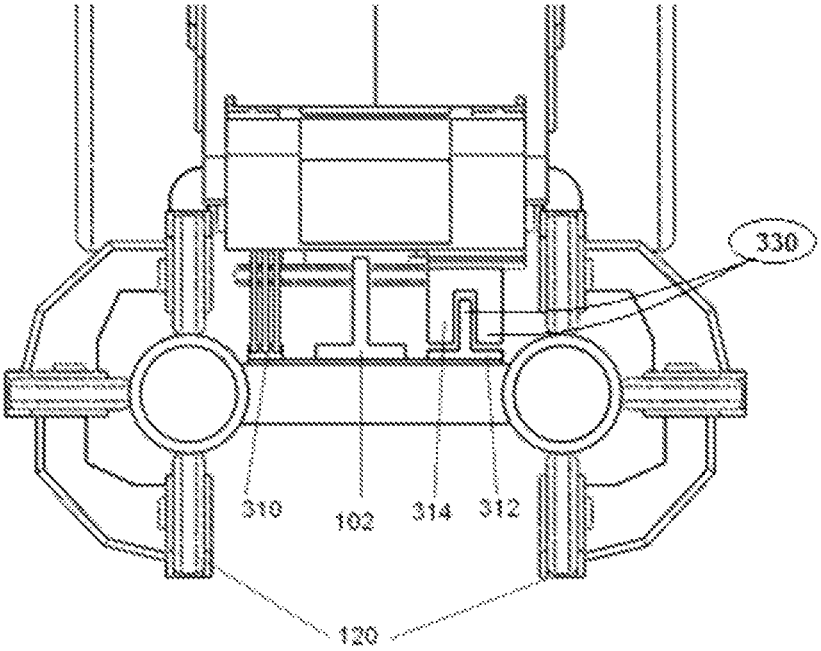
FIG. 4B is a front view of described amusement ride, and shows track and location of the set bars, the lunch system 330, drive blade, and bogies.
Figure 5A:
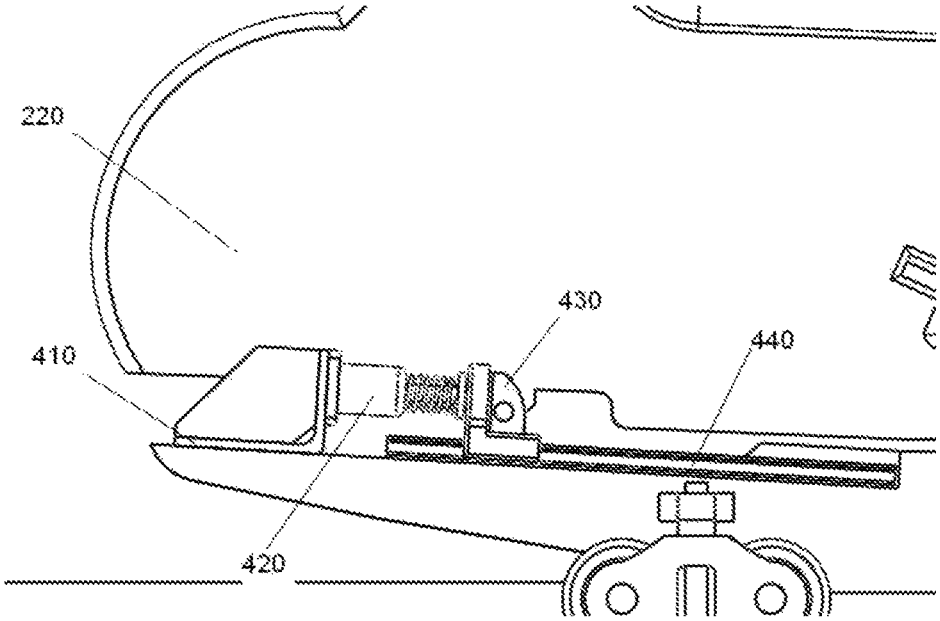
FIG. 5A is a side view of described amusement ride, and shows location of the shock absorbers and sliders.
Figure 5B:
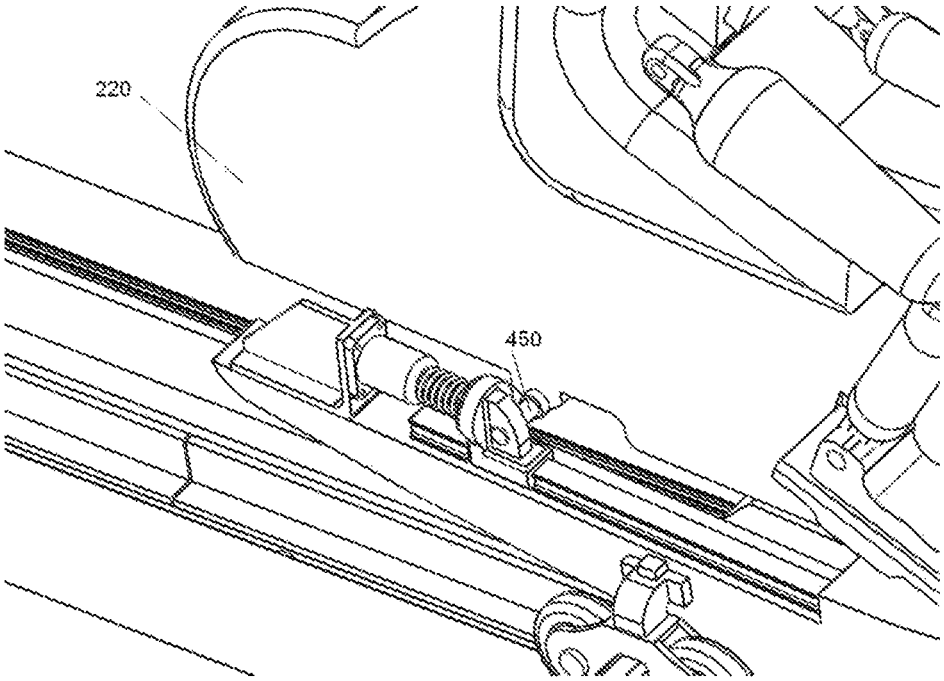
FIG. 5B is a perspective view of described amusement ride, and shows location of the shock absorbers and sliders.
Figure 6A:
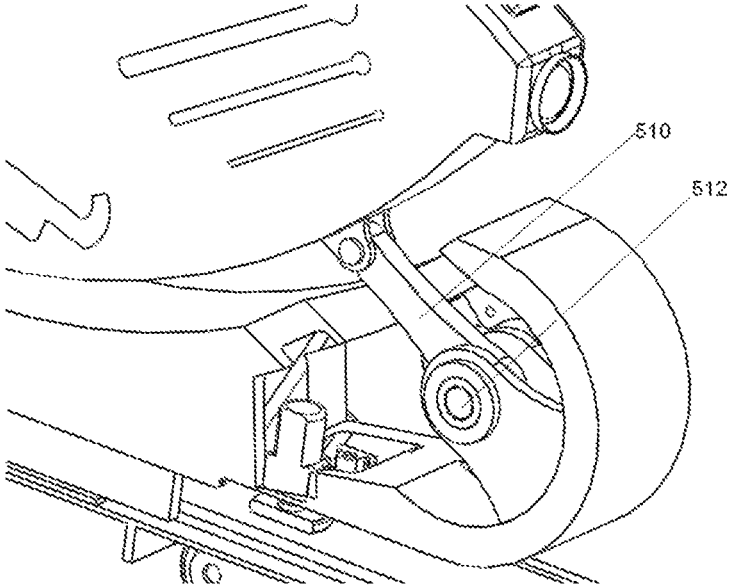
FIG. 6A is a perspective section view of described amusement ride, and shows connection between the drive means and the link-slide mechanism.
Figure 6B:
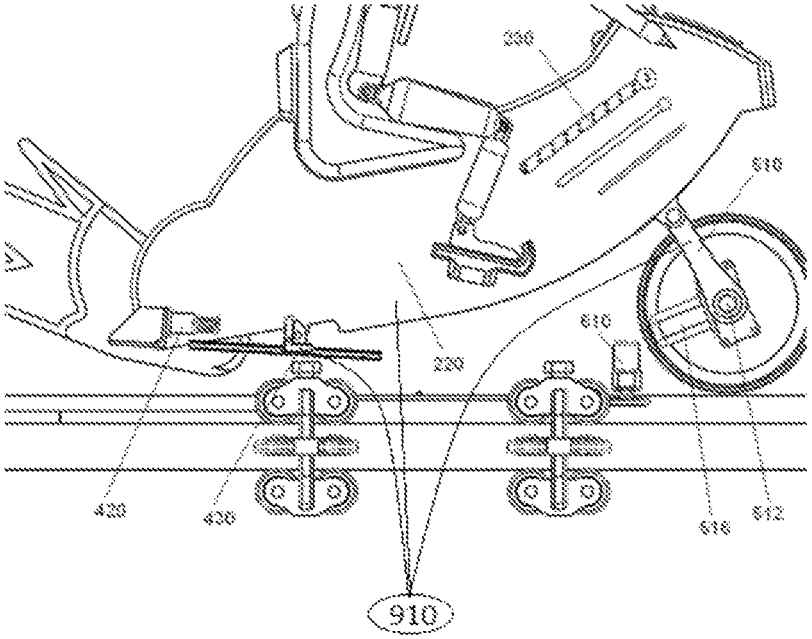
FIG. 6B is a side view of described amusement ride, and shows the drive means and link-slide mechanism 910.
Figure 7A:
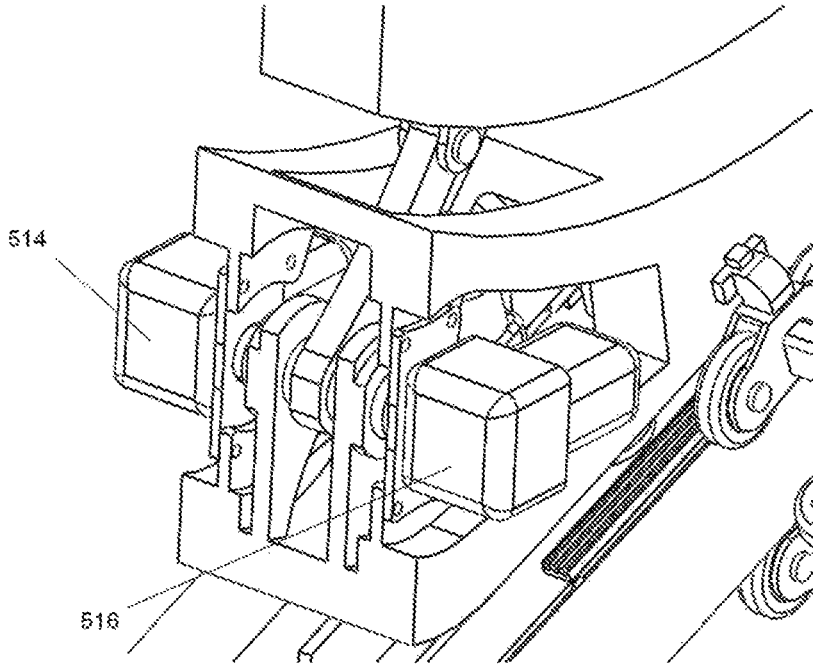
FIG. 7A is a perspective section view of described amusement ride, and shows the two sets of motor gearbox of the drive means.
Figure 7B:
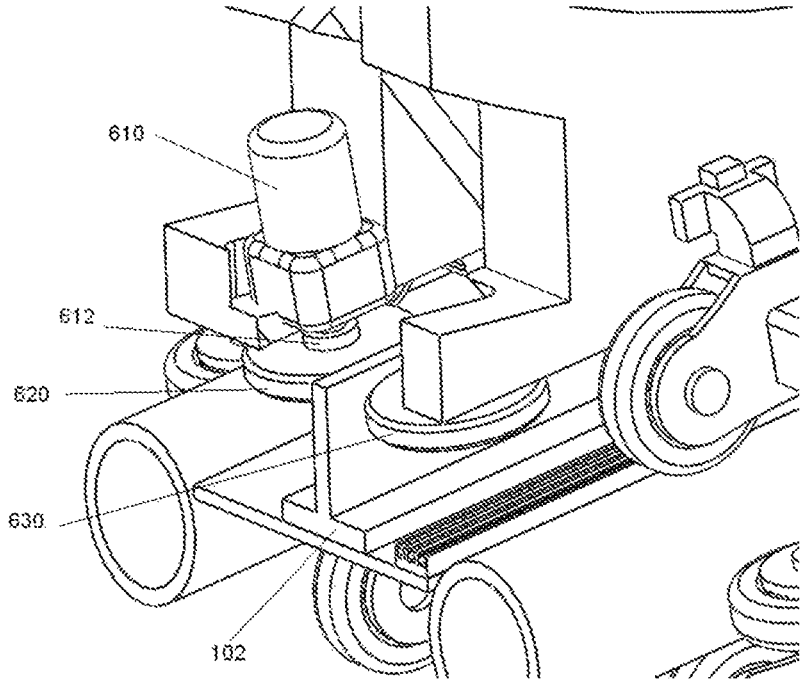
FIG. 7B is a perspective view of described amusement ride, and shows the propulsion drive means.
Figure 8A:
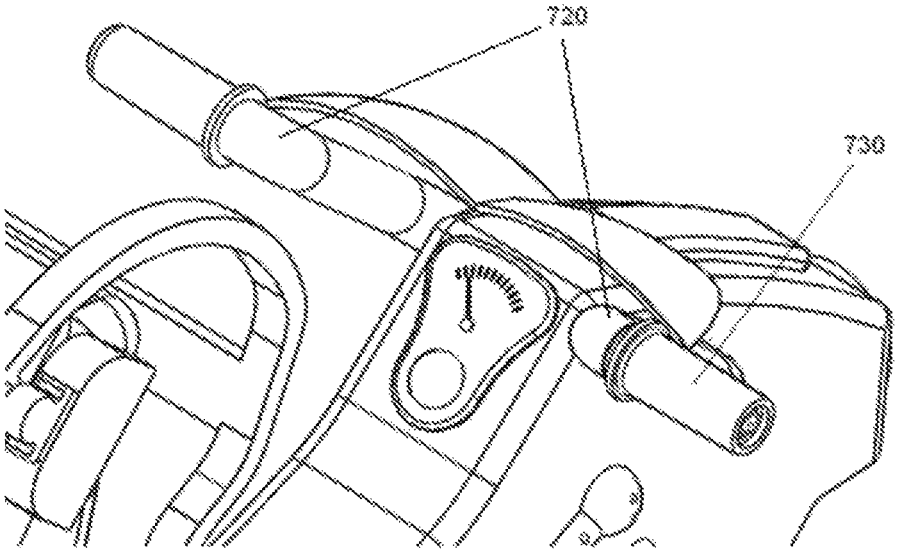
FIG. 8A is a perspective view of described amusement ride, and shows the handlebars and motorcycle rotary hand gripe.
Figure 8B:
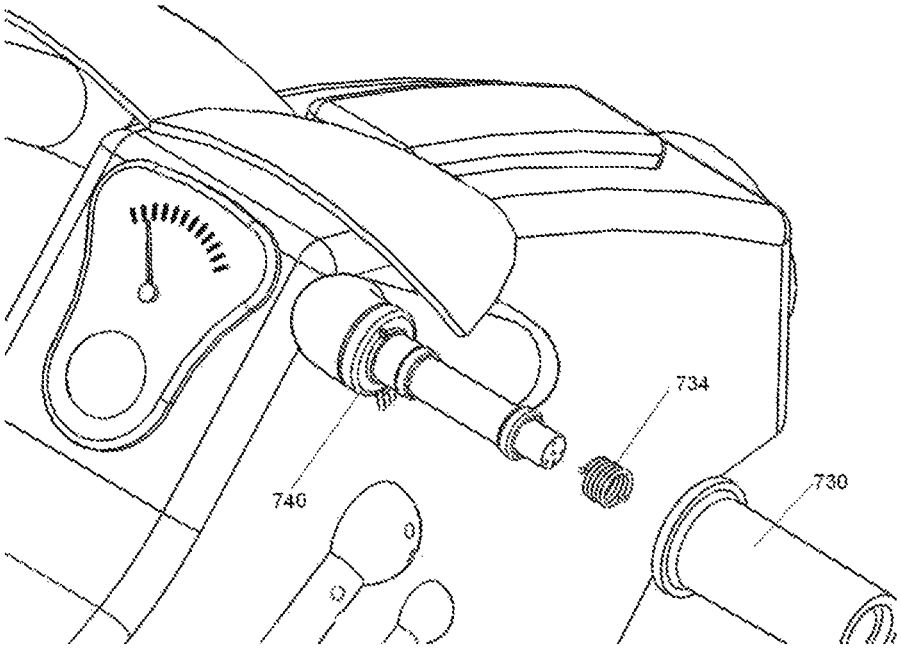
FIG. 8B is an exploded perspective view of described amusement ride, and shows components of the motorcycle rotary hand gripes.
Figure 9:
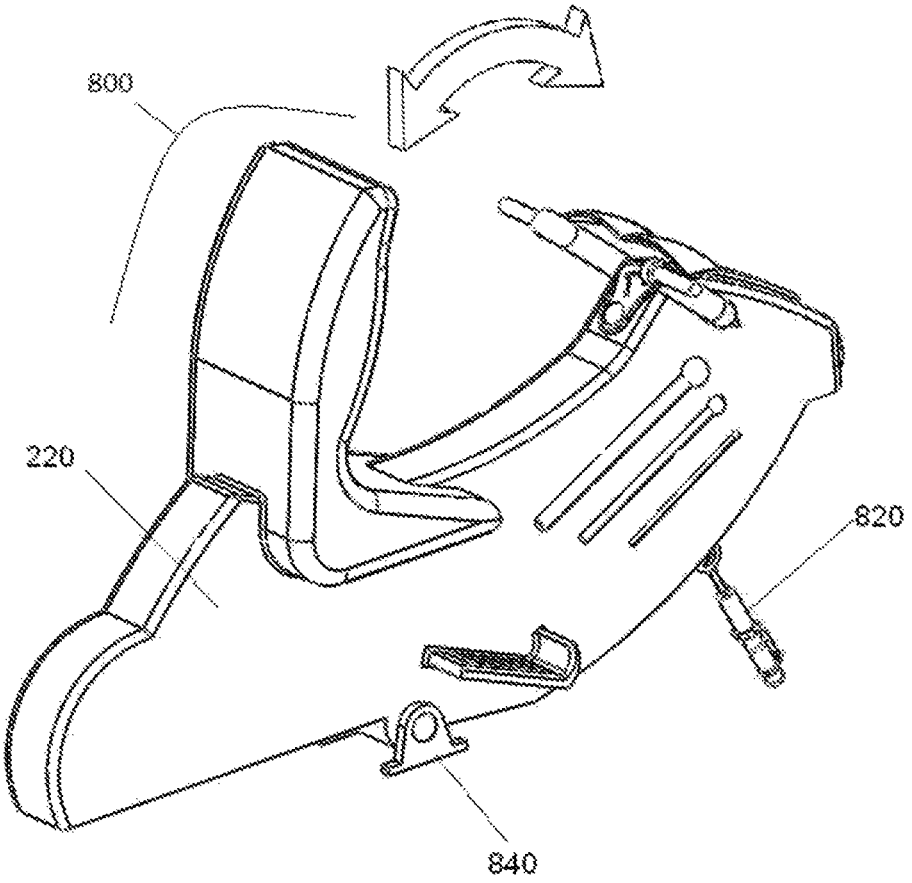
FIG. 9 is a perspective view of described amusement ride, and shows another aspect of the invention and link-slide mechanism so that using a linear actuator and moving body pivotally connected to the main body.

Referring to FIGS. 1 to 9, the preferred embodiment of an amusement ride, according to present invention is shown to comprise:

The track, the vehicle, the link-slide mechanism, the drive means, the launch system, the propulsion drive means, and the bus bars.

The track 290 includes at least two running rails are preferably configured with one or more of group consisting of turns, loops and inversion. (See FIG. 3A);

The vehicle arranged to carry at least one rider on a respective running rails includes the main body 240 having a rear end, a front end, a bottom section, and a top section, at least two sets of bogies 120, 140 installed at a rear end and a front end of said bottom section of the main body for the purpose of mounting and guiding the vehicle on the respective running rail 290, each set of bogie including at least two bogies installed laterally at both side of the main body of the main body 240 of the vehicle. (See FIGS. 3A, 4A, and 4B)

The link-slide mechanism includes moving body 220 installed on the top section of said main body of the vehicle, said moving body 220 moves forward/backward while it is tilted up/down, said moving body having a top section, a bottom section, a front section, and a rear section, at least one seat 250 installed at said top section of the moving body 220 for siting the rider, at least one restrain 260 installed at a rear of said top section of the moving body maintaining the rider safely during the riding, two footrests 270, 271 laterally installed at said bottom section of the moving body 220 maintaining the rider's feet during the riding, at least one speaker 230 installed on the moving body 220 playing proper sound of engine during the riding, two handlebars 720 mounted to said front section of the moving body 220, a motorcycle rotary hand gripe 730 installed on the handlebars and enabling the rider to rotate motorcycle rotary hand gripe 730 to send a signal to said at least one speaker 230, also accelerating the vehicle, and moves link-slide mechanism. (See FIGS. 3A, 6B, and 8A)

The link-slide mechanism further comprises a main shaft 512 pivotally connected to the front end of the main body 240 of the vehicle, at least one crank arm 510 having rear end and a front end, said rear end of the crank arm 510 fixed on the main shaft 512, said front end of the crank arm 510 pivotally connected to a front of said bottom section of the moving body 220 of the link-slide mechanism.

The drive means comprises at least one motor gearbox 516 fixed at the front end of said main body 240 of the vehicle, said motor gearbox 516 coupled to the main shaft 512 of the link-slide mechanism and generating required torque to move and tilting the moving body 220.

The link-slide mechanism further comprises a slide means, said slide means includes at least one linear rail 440 longitudinally fixed at the rear end of the main body 240 of the vehicle, at least one slider 430 having a bottom and a top, said bottom of the slider 430 slidably connected to said at least one linear rail 440, said top of the slider 430 pivotally connected to a rear of the bottom section of the moving body 220 of the link-slide mechanism.

The vehicle further comprises an absorbing means, said absorbing means comprises at least one shock absorber 420 longitudinally fixed at the rear end of the main body 240 of the vehicle damping kinetic energy of the link-slide mechanism when retracts and reaches a limit point. (See FIGS. 5A, 6A, 6B, and 7A)

The described amusement ride enabling said at least one rider changing an orientation and a position of said at least one rider in relation to the vertical line 200 so that said at least one rider is tilted up/down. (See FIGS. 3A and 3B)

The launch system includes at least one linear motor 314 installed at said bottom of the main body 240 of the vehicle, and a at least one linear stator 312 installed on the respective running rail, The launch system accelerating and launching the vehicle. (See FIG. 4B)

The propulsion drive means includes at least one set motor gearbox and roller 610, 620 installed at said bottom section of said main body 240 of the vehicle, said motor gear box 610 having an output shaft, a freewheel clutch 612 having an outer ring and an inner ring, said inner ring of the free wheel clutch 612 fixed on said output shaft of a motor gearbox 610, a driver roller 620 whose center fixed on said outer ring of said freewheel clutch and having outside surface tangentially engaging the drive blade 102 of the respective running rails 290, and a roller 630 whose center is rotatably connected to said bottom section of said main body 240 of the vehicle and having outside surface tangentially engaging the drive blade 102 of the respective running rails 290; the motorcycle rotary hand gripe 730 enabling the rider sending a command to the propulsion drive means and accelerating the vehicle, the position of the motor gearbox and roller are adjustable. (See FIGS. 6A, and 7B)

The vehicle park mechanism installed on a ground for maintaining said vehicle in the park position while it is loaded.

The bus bar 310 includes moving parts installed on said bottom section of said main body of the vehicle, and stators installed on the respective running rails for the purpose of transferring electrical power to the vehicle. (See FIG. 4B)

Another Aspect of Described Amusement Ride

Another aspect and advantages of described invention will become apparent in the following description.

The described amusement ride can be configured so that said at least one link-slide mechanism is replaced by at least one moving mechanism 800. In this embodiment a middle section of the moving body 220 pivotally connected to the main body 240 of the vehicle by the means of one set pillow block bearing 840, and said front section of the moving body 220 pivotally connected to a front end of a linear actuator 820; the middle section of the linear actuator 820 pivotally connected to the main body 240 of the vehicle, said linear actuator tilting moving body 220 up and down while linear actuator is retracted and extended. (See FIG. 9)

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangement.

What is claimed is:

1. An amusement, comprising:

a track including at least one supporting column, at least one set of running rails having an embark point; said at least one supporting column having a bottom section and a top section, said bottom section of said at least one supporting column adapted to be mounted on a ground, and said top section of said supporting column connected to said at least one set of running rails to support said amusement ride;

at least one vehicle arranged to carry at least one rider along said at least one set of running rails, said at least one vehicle mounted and guided on said at least one set of running rails, said at least one vehicle comprises a main body;

at least one link-slide mechanism mounted on said main body of said at least one vehicle, said at least one link-slide mechanism comprises a moving body, said moving body having a rear section operatively associated with the main body such that said rear section of the moving body moves backward/forward, and having a front section operatively associated with the main body such that said front section of the moving body tilts up and down; said at least one link-slide mechanism further comprises at least one slide means mounted on the main body and pivotally connected to the rear section of the moving body such that the rear section of the moving body moves forward/backward longitudinally on the main body; a seat mounted on a top section of the moving body for seating said at least one rider;

at least one drive means mounted between the main body and said at least one link-slide mechanism generating required power to move said at least one link-slide mechanism and tilting the moving body up and down and changing a position, and an orientation of said at least one rider in relation to a vertical line during a riding;

at least one launch system accelerating or providing initial motion to said at least one vehicle; and, at least one set bar mounted between said at least one set of running rails and said at least one vehicle; said at least one set bar transferring electrical power to said at least one vehicle.

2. The amusement ride of claim 1 wherein said at least one vehicle moves along said at least one set of running rails which is configured with one or more of groups consisting of turns, loop, and inversion.

3. The amusement ride of claim 1 wherein said at least one vehicle further comprises at least two sets of bogies mounting and guiding the main body on said at least one set of running rails.

4. The amusement ride of claim 1 wherein said at least one link-slide mechanism further comprises a crank arm having a rear section engaged to said drive means and a front section pivotally connected to the front section of the moving body such that said front section of the moving body tilts up and down.

5. The amusement ride of claim 1, wherein said at least one moving body further comprises at least one motorcycle rotary hand grip enabling said at least one rider to activate said at least one drive means by rotating said at least one motorcycle rotary hand grip.

6. The amusement ride of claim 1 enabling said at least one rider to change the orientation and the position of said at least one rider in relation to a vertical line so that said at least one rider is tilted up/down while moves forward/backward during a riding.

7. An amusement, comprising:

a track including at least one supporting column, at least one set of running rails having an embark point, and at least one drive blade fixed at a middle of said at least one set of running rails and extended longitudinally through said at least one set of running rails, said at least one supporting column having a bottom section and a top section, said bottom section of said at least one supporting column adapted to be mounted on a ground, and said top section of said supporting column connected to said at least one set of running rails to support said amusement ride;

at least one vehicle arranged to carry at least one rider along said at least one set of running rails, said at least one vehicle mounted and guided on said at least one set of running rails, said at least one vehicle comprises a main body;

at least one link-slide mechanism mounted on said main body of said at least one vehicle, at least one link-slide mechanism comprises a moving body, said moving body having a rear section operatively associated with the main body such that said rear section of the moving body moves backward/forward, and having a front section operatively associated with the main body such that said front section of the moving body tilts up and down; said at least one link-slide mechanism further comprises at least one slide means mounted on the main body and pivotally connected to the rear section of the moving body such that the rear section of the moving body moves forward/backward longitudinally on the main body; a seat mounted on a top section of the moving body for seating said at least one rider;

at least one drive means mounted between the main body and at least one link-slide mechanism generating required power to move said at least one link-slide mechanism and tilting the moving body up and down and changing a position and an orientation of said at least rider in relation to a vertical line during a riding;

at least one propulsion drive means mounted on the main body and engaging said at least one drive blade; said at least one propulsion drive means generating required power changing a speed of said at least one vehicle along said at least one set of running rails;

at least one launch system accelerating or providing initial motion to said at least one vehicle; and, at least one set bar mounted between said at least one set of running rails and said at least one vehicle; said at least one set bar transferring electrical power to said at least one vehicle.

8. The amusement ride of claim 7 wherein said at least one vehicle moves along said at least one set of running rails which is configured with one or more of groups consisting of turns, loop, and inversion.

9. The amusement ride of claim 7 wherein said at least one vehicle further comprises at least two sets of bogies mounting and guiding the main body on said at least one set of running rails.

10. The amusement ride of claim 7 wherein said at least one link-slide mechanism further comprises a crank arm having a rear section engaged to said drive means and a front section pivotally connected to the front section of the moving body such that said front section of the moving body tilts up and down.

11. The amusement ride of claim 7, said at least one moving body further comprises at least one motorcycle rotary hand grip enabling said at least one rider to activate said at least one drive means and said at least one propulsion drive means by rotating said at least one motorcycle rotary hand grip.

12. The amusement ride of claim 7 enabling at least one rider changing the speed of said at least one vehicle along said at least one set of running rails while changing the orientation and the position of said at least one rider in relation to a vertical line so that said at least one rider is tilted up/down while moves forward/backward during a riding.

13. The amusement ride of claim 7 wherein the propulsion drive means further comprises at least one set of motor gearbox and roller mounted to a bottom section of the main body and adapted to engage an outer surface of said at least one drive blade.

14. An amusement ride, comprising:

a track including at least one supporting column, at least one set of running rails having an embark point, and at least one drive blade fixed at a middle of said at least one set of running rails and extended longitudinally through said at least one set of running rails; said at least one supporting column having a bottom section and a top section, said bottom section of said at least one supporting column adapted to be mounted on a ground, and said top section of said supporting column connected to said at least one set of running rails to support said amusement ride;

at least one vehicle arranged to carry at least one rider along said at least one set of running rails, said at least one vehicle mounted and guided on said at least one set of running rails, said at least one vehicle comprises a main body;

at least one moving mechanism mounted on said main body of said at least one vehicle, said at least one moving mechanism comprises a moving body, said moving body having a rear section pivotally connected to the main body, and having a front section operatively associated with the main body such that said front section of the moving body tilts up and down; a seat mounted on a top section of the moving body for Seating said at least one rider;

at least one drive means mounted between the main body and said at least one moving mechanism generating required power to move moving mechanism and tilting the moving body up and down, and changing an orientation of said at least one rider in relation to a vertical line during a riding;

at least one propulsion drive means mounted on said at least one vehicle and engaging said at least one drive blade, said at least one propulsion drive means generating required power changing a speed of said at least one vehicle along said at least one set of running rails;

at least one launch system accelerating or providing initial motion to said at least one vehicle; and, at least one set bar mounted between said at least one set of running rails and said at least one vehicle; said at least one set bar transferring electrical power to said at least one vehicle.

15. The amusement ride of claim 14, wherein said at least one moving body further comprises at least one motorcycle rotary hand grip enabling said at least one rider to activate said at least one drive means by rotating said at least one motorcycle rotary hand grip.

16. The amusement ride of claim 14, wherein said at least one moving body further comprises at least one motorcycle rotary hand grip enabling said at least one rider to activate said at least one propulsion drive means by rotating said at least one motorcycle rotary hand grip.

17. The amusement ride of claim 14 enabling said at least one rider changing an orientation of said at least one rider in relation to a vertical line so that said at least one rider is tilted up/down.

18. The amusement ride of claim 14 enabling said at least one rider changing the speed of said at least one vehicle along said at least one set of running rails.

* * * * *